United States Patent [19]

Jansson

[11] Patent Number: 4,770,259

[45] Date of Patent: Sep. 13, 1988

[54] DRILL TOOL

[75] Inventor: Kjell-Ove L. Jansson, Sandviken, Sweden

[73] Assignee: Santrade Limited, Lucerne, Switzerland

[21] Appl. No.: 17,596

[22] Filed: Feb. 24, 1987

[30] Foreign Application Priority Data

Feb. 24, 1986 [SE] Sweden ..... 8600820

[51] Int. Cl.[4] ..... E21B 10/32; E21B 10/66

[52] U.S. Cl. ..... 175/258; 175/292; 175/398

[58] Field of Search ..... 175/258, 257, 260, 262, 175/263, 273, 284, 292, 384, 398, 259, 261

[56] References Cited

U.S. PATENT DOCUMENTS

| | | | |
|---|---|---|---|
| 3,416,616 | 12/1968 | Ahlgren | 175/258 |
| 3,648,789 | 3/1972 | Eriksson | 175/292 |
| 3,753,470 | 8/1973 | Lagerstrom et al. | 175/292 |
| 3,848,683 | 11/1974 | Persson | 175/258 |
| 3,870,114 | 3/1975 | Pulk | 175/258 |
| 4,408,669 | 10/1983 | Wiredal | 175/258 |
| 4,440,244 | 4/1984 | Wiredal | 175/292 |
| 4,545,443 | 10/1985 | Wiredal | 175/258 |
| 4,620,600 | 11/1986 | Persson | 175/398 |

FOREIGN PATENT DOCUMENTS 411139 3/1979 Sweden .

*Primary Examiner*—Stephen J. Novosad
*Assistant Examiner*—Terry Lee Melius
*Attorney, Agent, or Firm*—Burns, Doane, Swecker & Mathis

[57] ABSTRACT

A drill tool for rotary and/or percussion drilling includes a drill string and a cutting apparatus connected to a lower end of the drill string. The cutting apparatus has an intermediate portion which is rotatable with the drill string and includes an outer surface, a reamer is mounted eccentrically on the intermediate portion for rotation relative thereto about a longitudinal axis. The reamer includes an inner surface facing the outer surface. The reamer is driven by an arrangement comprised of a tongue disposed on either of the inner and outer surfaces and a pair of circumferentially spaced shoulder surfaces disposed on the other of the inner and outer surfaces. The tongue is selectively engageable with the shoulder surfaces along an area of contact having an upper longitudinal end which terminates below an uppermost end of the reamer, and a lower longitudinal end which terminates above a lowermost end of the reamer.

14 Claims, 2 Drawing Sheets

DRILL TOOL

The present invention relates to a drill tool for rotary and/or percussive drilling comprising a central pilot bit and a, in the feed direction of the tool, behind the pilot bit located eccentric reamer that via guide means is connected to a drill string that is rotatably coupled to a drill machine, said drill string and guide means being at least partially surrounded by a casing tube, means for supplying flush medium to the tool and means for removing flush medium and cuttings from the tool.

From SE, B, No. 411139 is previously known a device of the above-mentioned type. In this device the eccentric reamer is driven through an upper contact surface on the pilot bit and a co-operating lower contact surface on the reamer, said contact surfaces being inclined to the longitudinal axis of the device. The co-operation of the surfaces is present when the reamer is driven in its eccentric position.

This structural design does, however, present a number of disadvantages. The application of the feed force for the rotary motion is carried out in the lower region of the reamer. This means a certain inclination of the axis of rotation for the reamer relative to the axis of rotation for the guide means. Further a certain wedge action occurs between the inclined contact surfaces, which action can impose stresses on the neighbouring details and also functional disturbings when the reamer is transferred to a non-active position.

In the known device also the contact surfaces are exposed to outer damage that decreases the length of life both for the pilot bit and the reamer.

Due to the fact that the devices of the above-mentioned type are used for percussive/rotary drilling a certain part of the shock wave energy in the device according to SE, B 411139 will be transferred to the pilot bit via the inclined contact surfaces. This transfer of energy will together with bashing create pittings on these surfaces resulting in a damage of the surface layer and an accelerated wearing.

The devices of the above-mentioned type are used both in down-the-hole hammer drilling and top hammer drilling. However, due to tradition different rotary directions are used for these two types of drilling. In known devices having a reamer that is driven in accordance with the principle of SE, B, No. 411139 different types of reamers must be manufactured for down-the-hole hammer drilling and top hammer drilling. Of course, this is negative from the point of manufacturing and storage.

The aim of the present invention is to present a device of the above-mentioned type having the reamer and the guide means so designed that the above-mentioned functional disadvantages are eliminated. Besides the invention brings about a higher extent of standardizing of the reamer and the pilot bit.

Below two embodiments of the invention are described with reference to the enclosed drawings.

FIG. 1 discloses a schematic, partly sectioned, side view of a drill tool according to the invention.

FIG. 2 discloses a section along II—II in FIG. 1.

FIG. 3 discloses a partly sectioned side view of an alternative embodiment of a drill tool according to the invention; and FIG. 4 discloses a section along IV—IV in FIG. 3.

Detailed Description of Preferred Embodiments of the Invention

Figure 1:
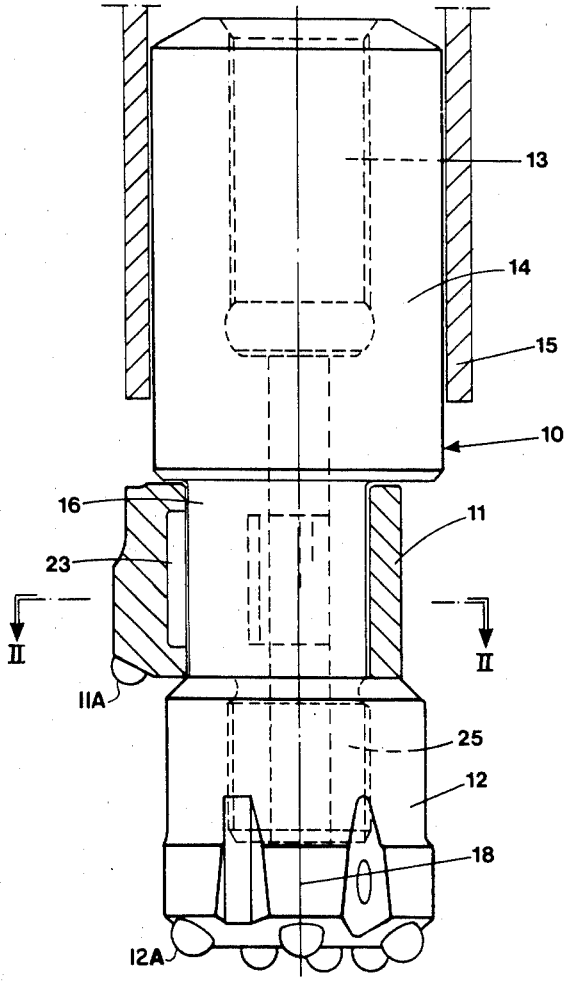
Figure 2:
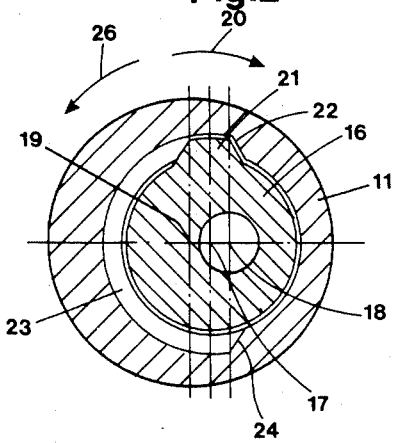

The device of FIGS. 1 and 2 for earth drilling comprises an eccentric drill tool having a guide body 10, an eccentric reamer 11 and a centric pilot bit 12. As is indicated by the threaded boring 13 the guide body 10 can be connected to a top hammer equipment (not shown). The reamer and pilot bit carry cutting elements 11A, 12A, respectively.

The upper portion 14 of the guide body 10 is surrounded by the lower end of a casing tube 15, that is driven down together with the drill tool during drilling operation.

The reamer 11 is carried on an intermediate portion 16 of the guide body 10, said portion 16 having a reduced diameter and the reamer 11 being rotatable a limited angle relative said intermediate portion 16. As can be seen from FIGS. 1 and 2 the intermediate portion 16 has its centre axis 17 located eccentrically with respect to the centre axis 18 of the guide body 10. Further the circumferential surface of the reamer 11 has a centre of rotation 19 that is located further eccentrically with respect to the centre axis 18 of the guide body 10, i e the wall thickness of the reamer 11 varies along its circumference. This structural design means that the radius of action for the reamer 11 reaches outside of the casing tube 15 as shown in FIGS. 1 and 2. If the reamer is rotated somewhat more than 180° clockwise from the position of FIGS. 1 and 2, its external contour will fall within the internal contour of the casing tube 15. This means that the whole eccentric drill tool can be pulled up through the casing tube 15.

In FIGS. 1 and 2 the reamer 11 is disclosed in an active position, the drill tool being rotated in the direction of the arrow 20 in FIG. 2. By rotation in direction of the arrow 20 a driving tongue 21 on an outer surface of the intermediate portion 16 will abut against a shoulder 22 on an inner surface of the reamer 11, said shoulder 22 being created by a recess 23 in the reamer 11. At the opposite end of the recess 23 spaced circumferentially from the shoulder 22 there is a corresponding shoulder 24.

In a conventional way the device is provided with a channel, preferably centrally located and with an axial extension. Flush medium is supplied to the front end of the drill tool through said channel.

In order to remove flush medium and cuttings from the front part of the drill tool the device is provided with suitable means, e.g. grooves arranged in the envelope surface of the upper part of the guide body 10.

The means to supply flush medium and remove flush medium and cuttings are not shown in the enclosed Figures, as these means do not constitute essential parts of the present invention.

The above described device works in the following way.

When the drill tool is rotated in the direction of the arrow 20 in FIG. 2 the tongue 21 will contact the shoulder 22 and consequently the reamer 11 will be driven in the direction of rotation. The hole that is created in this way by the eccentric drill tool has, as can be seen from FIG. 1, a sufficient large diameter to drive down the casing tube 15 at the same speed as the drilling rate of the drill tool.

Drilling with the above described equipment is done by a percussive/rotary drilling. Through the design of the driving tongue 21 and the adherent shoulders 22, 24 it is guaranteed that no shock wave is transferred via tongue-shoulder as is the case by prior art discussed in the preamble of the description. It is thus quite obvious that the wearing on the tongue—shoulder decreases compared to prior art due to the fact that the tongue 21 transfers only rotary motion to the shoulder 22. This means that the length of life for the guide body 10 and the reamer increases.

In the device according to the invention the shock wave is thus transferred to the pilot bit substantially only via the guide body 10. This means that the eccentric drill tool according to the present application is not especially sensitive to an increase in the working pressure of the compressed air. This is an important difference compared to the drill tool according to SE, B, No. 411139 that is very sensitive to an increase of the working pressure due to the fact that the blasting of the inclined shoulders is accentuated.

The characteristic that the device according to the present invention is rather unsensitive to an increase of the working pressure has an extremely great importance in practice. In the fields it is not uncommon that the working pressure is not adapted to the recommendations of the manufacturer.

As is indicated in FIG. 1 the pilot bit 12 is connected to the guide body 10 via a threaded plug 25 that is received in a threaded boring in the pilot bit 12. This structural design enables both the pilot bit 12 and the reamer 11 to be exchanged while the guide body 10 is maintained. This is advantageous since it is in average calculated that two pilot bits and four reamers are worn out before the guide body is consumed. In the equipment according to the above-mentioned SE, B, No. 411139 the pilot bit and the guide body are integral. This means that the length of life for the guide body cannot be fully exploited, at least not without grinding of the pilot bit.

By connecting the pilot bit 12 to the guide body 10 via a threaded plug 25 it is in principle possible to use a drill bit of standard type as a pilot bit.

When drilling has been carried out to the required level the guide body 10 and the pilot bit 12 are rotated in the direction of the arrow 26. The reamer 11 is not following this rotation but is kept in place through the engagement in the soil layer until the tongue 21 contacts the shoulder 24. When this position is achieved the reamer 11 will be inside of the prolongation of the casing tube 15 and consequently the whole eccentric drill tool can be pulled up through the tube 15.

Figure 3:
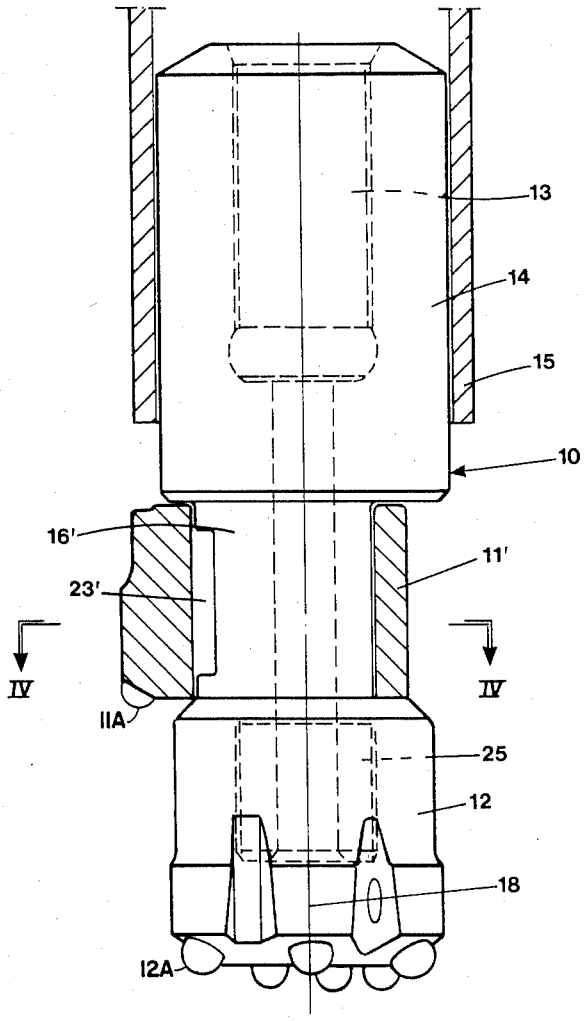
Figure 4:
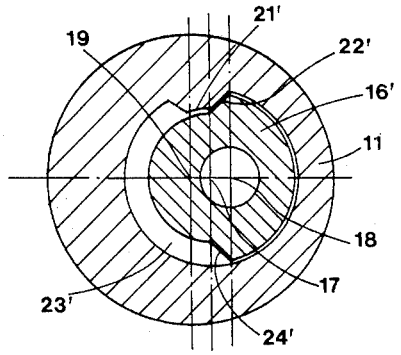

The embodiment disclosed in FIGS. 3 and 4 differs from the above described in that the driving tongue 21' is arranged on the reamer 11'. A further difference is that the intermediate portion 16' has a recess 23' provided with shoulders 22' and 24' respectively.

Concerning the working of the embodiment of FIGS. 3 and 4 it is fully correspondent to the working of the above described embodiment and therefore reference is made to the relevant parts of said above description.

Common for the two embodiments is that the driving tongue 21; 21' has an extension in the longitudinal direction of the eccentric drill tool, said extension corresponds to a major extent of the height of the reamer 11;11', at least half of the height of the reamer 11;11'. This guarantees that the driving is carried out without risk for jamming/clamping and fatigue of material resp in the cooperating parts (tongue—shoulder).

When mounting and dismounting the reamer 11;11' the pilot bit 12 is unscrewed from the plug 25 and then the reamer 11; 11' is pushed on or off the intermediate portion 16;16' of the guide body 10. To achieve this the upper end of the reamer 11 or the lower end of the intermediate portion 16' must be provided with a groove (not shown) that corresponds to the tongue 21;21'.

The disclosed embodiments refer to top hammer drilling. However, eccentric drill tools are also used in down-the-hole hammer drilling. The direction of rotation is opposite for these types of drilling. An extremely great advantage for the present invention is that the structural design of the reamer is alike regardless if it is used for top hammer drilling or down-the-hole hammer drilling.

The invention is not in any way restricted to the above described embodiments but can be varied within the scope of the appending claims.

I claim:

1. A hollow reamer for rotary and/or percussion drilling, said reamer including cutter means and having an internal surface defining a longitudinal axis, said reamer adapted to be mounted on an intermediate portion of a drill string such that the latter is rotatable relative to the former by less than 360 degrees, said reamer being driveable by a generally radially projecting tongue of the intermediate portion which is selectively engageable with a pair of shoulder surfaces on said inner surface, each of said shoulder surfaces having a longitudinal first end terminating proximate and short of a lowermost first end of said reamer, each of said shoulder surfaces having a longitudinal second end terminating proximate and short of a longitudinal second end of said reamer.

2. The reamer according to claim 1 wherein a longitudinal dimension between said first and second ends is at least one half the longitudinal dimension of said reamer.

3. A hollow reamer for rotary and/or percussion drilling, said reamer including cutter means and having an internal surface defining a longitudinal axis, said reamer adapted to be mounted on an intermediate portion of a drill string such that the latter is rotatable relative to the former by less than 360 degrees, said reamer being driveable by a pair of shoulder surfaces of said intermediate portion which are selectively engageable with a generally radially inwardly projecting tongue on said inner surface, said tongue having a longitudinal first end terminating proximate and short of a longitudinal first end of said reamer, said tongue having a longitudinal second end terminating proximate and short of a longitudinal second end of said reamer.

4. The reamer according to claim 3 wherein a longitudinal dimension between said first and second ends is at least one half the longitudinal dimension of said reamer.

5. A drill tool for rotary and/or percussion drilling, comprising a drill string rotatable about a longitudinal axis; and a cutting apparatus connected to a lower longitudinal end of said drill string, said cutting apparatus including:

a guide portion for guiding said cutting apparatus within a casing tube which surrounds the drill string during a drilling operation, a pilot bit disposed at a lower longitudinal end of said cutting apparatus, an intermediate portion disposed between said guide portion and said pilot bit and being of smaller cross section than said guide portion, said intermediate portion being rotatable with said drill string and including an outer surface, a hollow reamer mounted eccentrically on said intermediate portion for rotation relative thereto about a longitudinal axis, said reamer including an inner surface facing said outer surface, and means for driving said reamer comprising a generally radially outwardly projecting tongue on said outer surface and a pair of circumferentially spaced shoulder surfaces disposed on said inner surface in the path of rotation of said tongue so as to be selectively engaged by said tongue in response to rotation of said drill string in opposite directions relative to said reamer;

said tongue being engageable with each of said shoulder surfaces along an area of contact having an upper longitudinal end which terminates below an uppermost end of said reamer, and a lower longitudinal end which terminates above a lowermost end of said reamer.

6. The drill tool according to claim 5 wherein said contact area is disposed parallel to said longitudinal axis.

7. The drill tool according to claim 5 wherein said shoulder surfaces define circumferential ends of a recess in said reamer.

8. The drill according to claim 7 wherein said recess extends circumferentially for at least 180 degrees.

9. The drill according to claim 5 wherein said pilot bit is threadedly connected to said intermediate portion.

10. A drill tool for rotary and/or percussion drilling, comprising a drill string rotatable about a longitudinal axis; and a cutting apparatus connected to a lower longitudinal end of said drill string, said cutting apparatus including:

a guide portion for guiding said cutting apparatus within a casing tube which surrounds the drill string during a drilling operation, a pilot bit disposed at lower longitudinal end of said cutting apparatus, an intermediate portion disposed between said guide portion and said pilot bit and being of smaller cross section than said guide portion, said intermediate portion being rotatable with said drill string and including an outer surface;

a hollow reamer mounted eccentrically on said intermediate portion for rotation relative thereto about a longitudinal axis, said reamer including an inner surface facing said outer surface, and means for driving said reamer comprising a generally radially inwardly projecting tongue on said inner surface and a pair of circumferentially spaced shoulder surfaces arranged on said outer surface such that said tongue lies in a path of rotation of said shoulder surfaces and is engaged by said shoulder surfaces in response to rotation of said drill string in opposite directions relative to said reamer;

each of said shoulder surfaces being engageable with said tongue along an area of contact having an upper longitudinal end which terminates below an uppermost end of said reamer, and a lower longitudinal end which terminates above a lowermost end of said reamer.

11. The drill tool according to claim 10 wherein said contact area is disposed parallel to said longitudinal axis.

12. The drill tool according to claim 10 wherein said shoulder surfaces define circumferential ends of a recess in said intermediate portion.

13. The drill according to claim 12 wherein said recess extends circumferentially for at least 180 degrees.

14. The drill according to claim 10 wherein said pilot bit is threadedly connected to said intermediate portion.

* * * * *